United States Patent [19]

Szczesniak

[11] Patent Number: 4,770,306

[45] Date of Patent: Sep. 13, 1988

[54] LOCATION OF BRIDGES ON TAMPER BANK STYLE CLOSURES

[75] Inventor: Dennis A. Szczesniak, Justice, Ill.

[73] Assignee: Continental White Cap Inc., Northbrook, Ill.

[21] Appl. No.: 583,544

[22] Filed: Feb. 24, 1984

[51] Int. Cl.[4] ..... B65D 41/34

[52] U.S. Cl. ..... 215/252; 215/253

[58] Field of Search ..... 215/252, 253, 258

[56] References Cited

U.S. PATENT DOCUMENTS

| | | | |
|---|---|---|---|
| 4,098,419 | 7/1978 | Virog, Jr. et al. | 215/252 |
| 4,147,268 | 4/1979 | Patel et al. | 215/253 X |
| 4,333,577 | 6/1982 | Mumford | 215/252 X |
| 4,402,418 | 9/1983 | Ostrowsky | 215/252 |

*Primary Examiner*—Steven M. Pollard

*Attorney, Agent, or Firm*—Charles E. Brown; Paul Shapiro; Charles A. Brown

[57] ABSTRACT

This relates to closures which are screw threaded onto container neck finishes and which are provided with tamper indicating bands connected to the closure by rupturable bridges. The closure is improved by specifically limiting the number of bridges and specifically locating the bridges relative to the starting end or ends of a related thread or threads so as to assure fracture of all bridges upon each opening of a container by unthreading the closure. This abstract forms no part of the specification of this application and is not to be construed as limiting the claims of the application.

14 Claims, 1 Drawing Sheet

LOCATION OF BRIDGES ON TAMPER BANK STYLE CLOSURES

This invention relates in general to new and useful improvements in closures having tamper bands, and more particularly to the location of bridges between a tamper band of a closure and starting ends of thread or threads of such closures.

There has been in use for a period of time closures which have depending from the skirts thereof tamper indicating bands which lock beneath a bead on a neck finish and which are connected to the closure skirts by a plurality of circumferentially spaced bridges. It has been found, however, that the bridges do not always break, and this poses difficulties in the removal of the closures from the associated containers. This invention particularly relates to the location of the bridges with respect to a thread starting end so as to assure the breakage of all bridges, leaving the tamper indicating band attached to the neck finish while permitting ease of removal of the closure per se.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
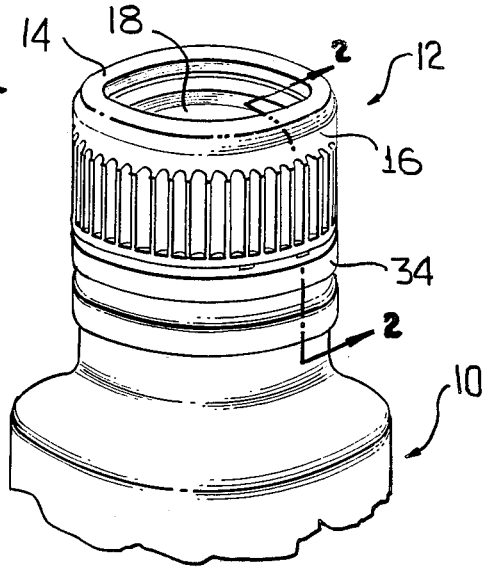
FIG. 1 is a top perspective view of a container having a screw threaded closure provided with a tamper indicating band in accordance with this invention.
Figure 2:
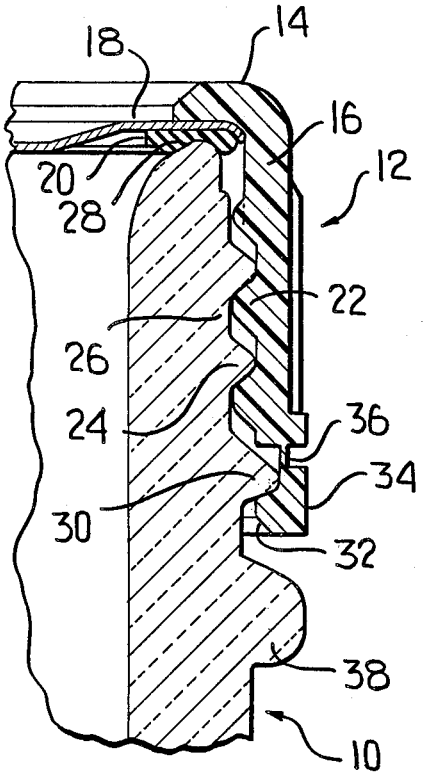
FIG. 2 is an enlarged fragmentary sectional view taken generally along the line 2—2 of FIG. 1, and shows the cross-sectional details of the closure and a related container neck finish.

Referring now to the drawings in detail, there is illustrated in FIG. 1 a conventional container 10 which is closed by a conventional screw threaded closure 12. The closure 12 may take many forms, but as is best illustrated in FIG. 2 includes an end annulus 14 which terminates in the upper end of a skirt 16. The closure 12 is provided with a separate end panel 18 which is provided with a suitable gasket ring 20. If desired, the annulus 14 and the end panel 18 may be integrally formed.

The skirt has formed on the inner surface thereof a continuous thread 22 which engages with a like continuous thread 24 on a neck finish 26 of the container 10. The neck finish 26 terminates in a sealing lip 28 which is embedded in sealing relation within the gasket 20.

In accordance with this invention, below the thread 24 the neck finish 26 is provided with a locking bead 30 beneath which engages an inner flange 32 of a tamper indicating band 34. The tamper indicating band 34 is integrally formed with the closure 12 and is disposed below and connected to the lower edge of the skirt 16 by a plurality of uniformly circumferentially spaced bridges 36. If desired, the neck finish 26 may also include a protruding bead 38 which overlies the tamper indicating band 34.

Figure 3:
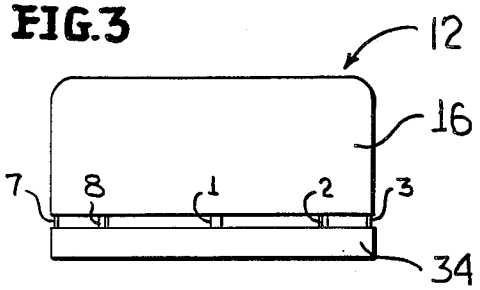
FIG. 3 is an elevational view of a conventional type of closure having a tamper indicating band connected to the lower edge of its skirt by eight uniformly circumferentially spaced bridges.

Reference is now made to FIG. 3 wherein the closure 12 is schematically shown in elevation and shows the tamper indicating band 34 connected to the lower part of the skirt 16 by eight of the bridges 36 bearing the numbers 1–8, only the bridges 1, 2, 3, 7 and 8 appearing in FIG. 3.

Figure 4:
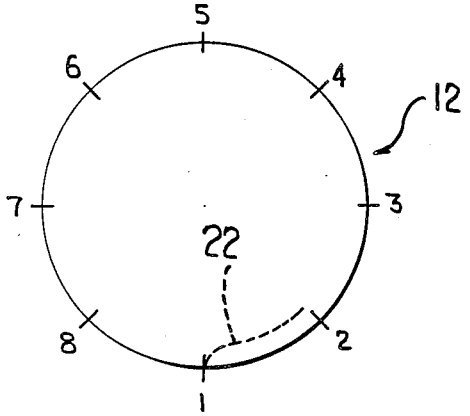
FIG. 4 is a diagrammatic plan view showing the position of the bridges of the closure of FIG. 3 and the relationship thereof to the starting end of the thread.

In FIG. 4 there is a schematic plan view of the closure 12, showing the bridge 1 aligned with the starting or lead end of the thread 22. When the bridges 36 are so located, the bridge 1, located under the thread start, will break first, followed by the breaking of the bridge 2. The bridges located 90° from bridge 1, i.e., bridges 3 and 4, have a greater tendency not to fracture over bridges 1 and 2.

Under the circumstances, a series of tests was conducted wherein not all eight bridges were utilized. In one form of the invention, only bridges 1, 2, 5 and 6 were utilized. With this arrangement, it was found that all bridges were broken a majority of the time.

On the other hand, when only bridges 3, 4, 7 and 8 were utilized, at least one bridge was left intact a majority of the time upon opening.

Samples were also made with only bridges 1, 3, 5 and 7. With this arrangement at least one bridge was left intact a majority of the time.

Most particularly, bridges 3 and 4 were the most likely to stay intact.

Figure 5:
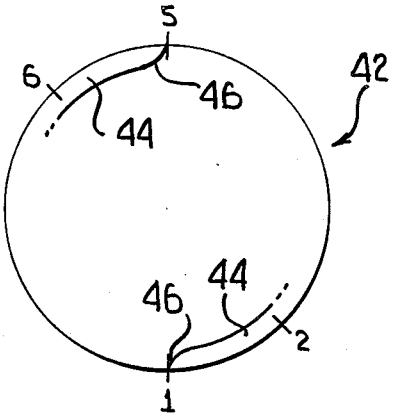
FIG. 5 is a schematic plan view similar to FIG. 4, and shows the position of bridges with respect to thread starting ends in accordance with this invention.
Figure 6:
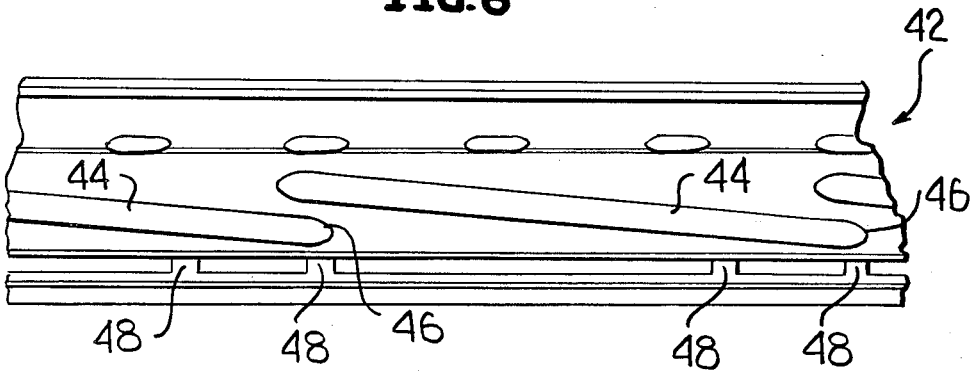
FIG. 6 is a developed elevational view of a closure formed in accordance with this invention.

Referring now to FIG. 5, there is illustrated schematically a plan view of a closure thread and bridge arrangement in accordance with this invention, the closure being generally identified by the numeral 42 and having threads 44 which include two thread starts 46. The number of bridges 48 between a skirt 50 of the closure 42 and a tamper indicating band 52 was reduced to four, with the bridges 48 being located at the position of bridges 1, 2, 5 and 6 of FIG. 4 as is schematically shown in FIG. 5. With the bridges 48 so located with respect to one another and with respect to the starts 46 of the threads 44, as well as the dual thread arrangement, an extremely high bridge fracture has been obtained.

Although the specifics of the closure 42 have not been illustrated or described in full detail, it is to be understood that the closure 42 will correspond to the closure 12 or a modification thereof with the exception of the dual threads 44 and the limited number of and specifically placed bridges 48 as compared to the single thread 22 and the eight bridges 36.

Although only a preferred embodiment of the closure and tamper indicating band bridge arrangement has been specifically illustrated and described herein, it is to be understood that minor variations may be made in the closure construction without departing from the spirit and scope of the invention as defined by the appended claims.

I claim:

1. A closure for a container having a threaded neck finish, said closure comprising a cap portion including an end portion and a depending skirt, and a tamper indicating band carried by said cap portion, said tamper indicating band being carried by said skirt and being connected to said skirt by rupturable bridges, said skirt having a plurality of threads projecting radially inwardly from an inner surface of said skirt, and each of said threads having a starting end; said closure being improved by there being one of said bridges generally axially aligned with each of said thread starts.

2. A closure according to claim 1 wherein there is a second of said bridges immediately circumferentially adjacent to each of said one bridge in the circumferential direction of said threads.

3. A closure according to claim 1 wherein there are two only of said threads.

4. A closure according to claim 3 wherein there is a second of said bridges immediately circumferentially adjacent to each of said one bridge in the circumferential direction of said threads.

5. A closure according to claim 2 wherein said bridges of each pair of said one bridge and said second bridge are circumferentially spaced through an angle on the order of 90°.

6. A closure according to claim 5 wherein there are two only of said threads.

7. A closure according to claim 1 wherein said one bridge is substantially circumferentially centered on a respective thread starting end.

8. A closure according to claim 2 wherein said bridges are restricted to said one bridge and said second bridge for each of said threads.

9. A closure according to claim 8 wherein there are two only of said threads.

10. A closure according to claim 8 wherein said one bridge is substantially circumferentially centered on a respective thread starting end.

11. A closure according to claim 2 wherein there are two others of said bridges located 180° from each of said one bridge and said second bridge.

12. A closure according to claim 11 wherein said bridges of each pair of said one bridge and said second bridge are circumferentially spaced through an angle on the order of 90°.

13. A closure according to claim 11 wherein there are two only of said threads.

14. A closure according to claim 2 wherein there are two others of said bridges located 180° from each of said one bridge and said second bridge, and there are no other bridges.

* * * * *